US006420839B1

(12) United States Patent
Chiang et al.

(10) Patent No.: US 6,420,839 B1
(45) Date of Patent: Jul. 16, 2002

(54) POWER SUPPLY SYSTEM FOR MULTIPLE LOADS AND DRIVING SYSTEM FOR MULTIPLE LAMPS

(75) Inventors: Yi-Chao Chiang; Wei-Hong Lin; Kun-Tsung Chou, all of Hsinchu (TW)

(73) Assignee: Ambit Microsystems Corp. (TW)

( * ) Notice: Subject to any disclaimer, the term of this patent is extended or adjusted under 35 U.S.C. 154(b) by 0 days.

(21) Appl. No.: 09/825,933

(22) Filed: Apr. 5, 2001

(30) Foreign Application Priority Data

Jan. 19, 2001 (TW) ..... 090101318

(51) Int. Cl.[7] ..... G05F 1/00

(52) U.S. Cl. ..... 315/311; 315/307; 315/291; 315/224

(58) Field of Search ..... 315/311, 310, 315/307, 291, 297, 224, 321

(56) References Cited

U.S. PATENT DOCUMENTS 4,698,554 A * 10/1987 Stupp et al. ..... 315/307
5,621,281 A * 4/1997 Kawabata et al. ..... 315/311
6,028,400 A * 2/2000 Pol et al. ..... 315/225
6,104,146 A * 8/2000 Chou et al. ..... 315/277
6,215,256 B1 4/2001 Ju ..... 315/307
6,310,444 B1 * 10/2001 Chang ..... 315/282

* cited by examiner

*Primary Examiner*—Don Wong
*Assistant Examiner*—Tuyet T. Vo
(74) *Attorney, Agent, or Firm*—Michael D. Bednarek; Shaw Pittman LLP

(57) ABSTRACT

The present invention relates to a driving system for multiple lamps, which comprises a plurality of lamps including one master lamp and at least one slave lamp, an inverter circuit for converting DC power to AC power to be supplied to said plurality of lamps, and at least one current balancing circuit having an impedance device coupled to each of the slave lamp, so that the equivalent impedance varies with the current values of said master lamp and each of said slave lamps to thereby balance the currents in said master slave lamps.

32 Claims, 9 Drawing Sheets

Fig. 1 〈 PRIOR ART 〉

Fig. 2 〈 PRIOR ART 〉

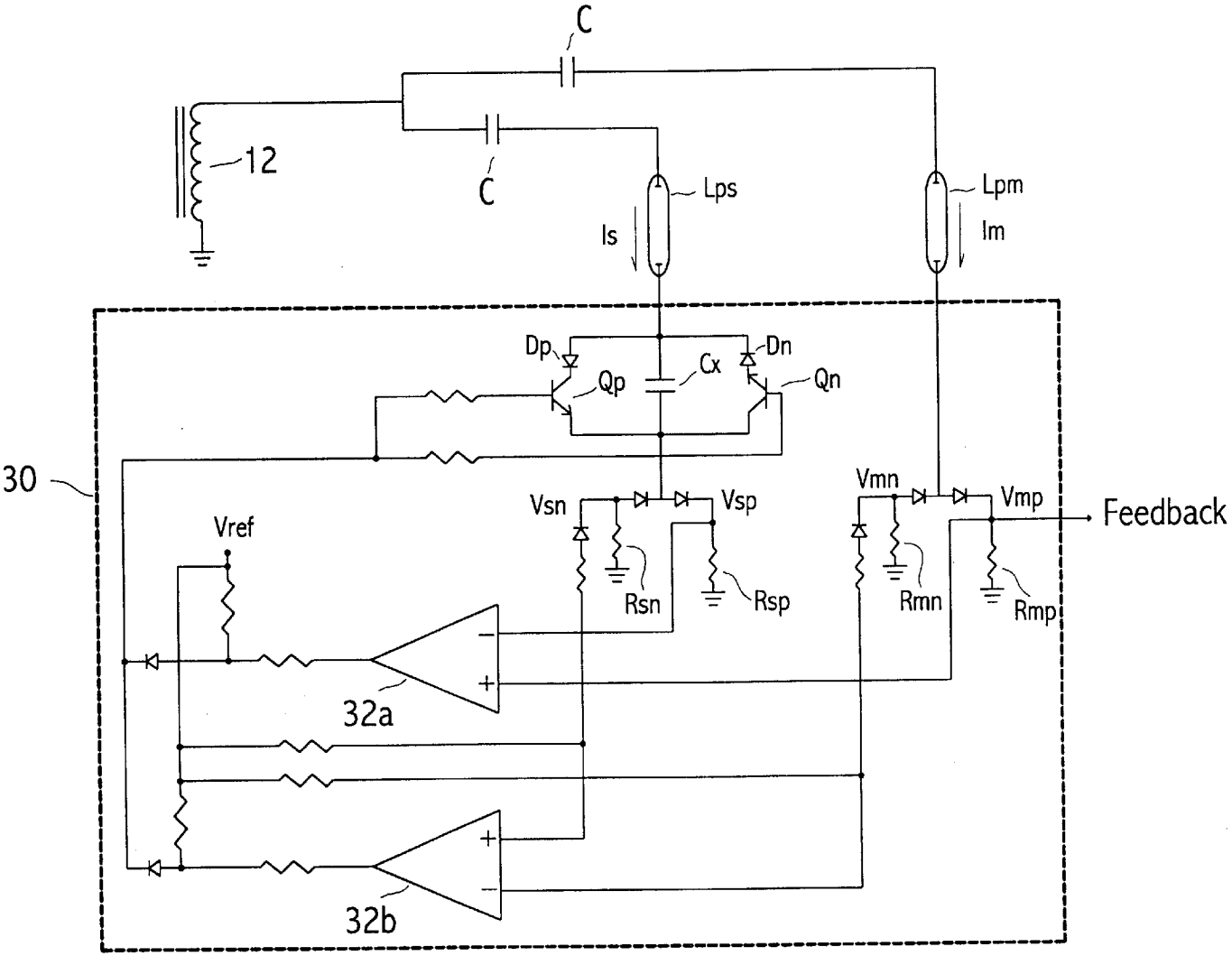
Fig. 5 〈 a 〉

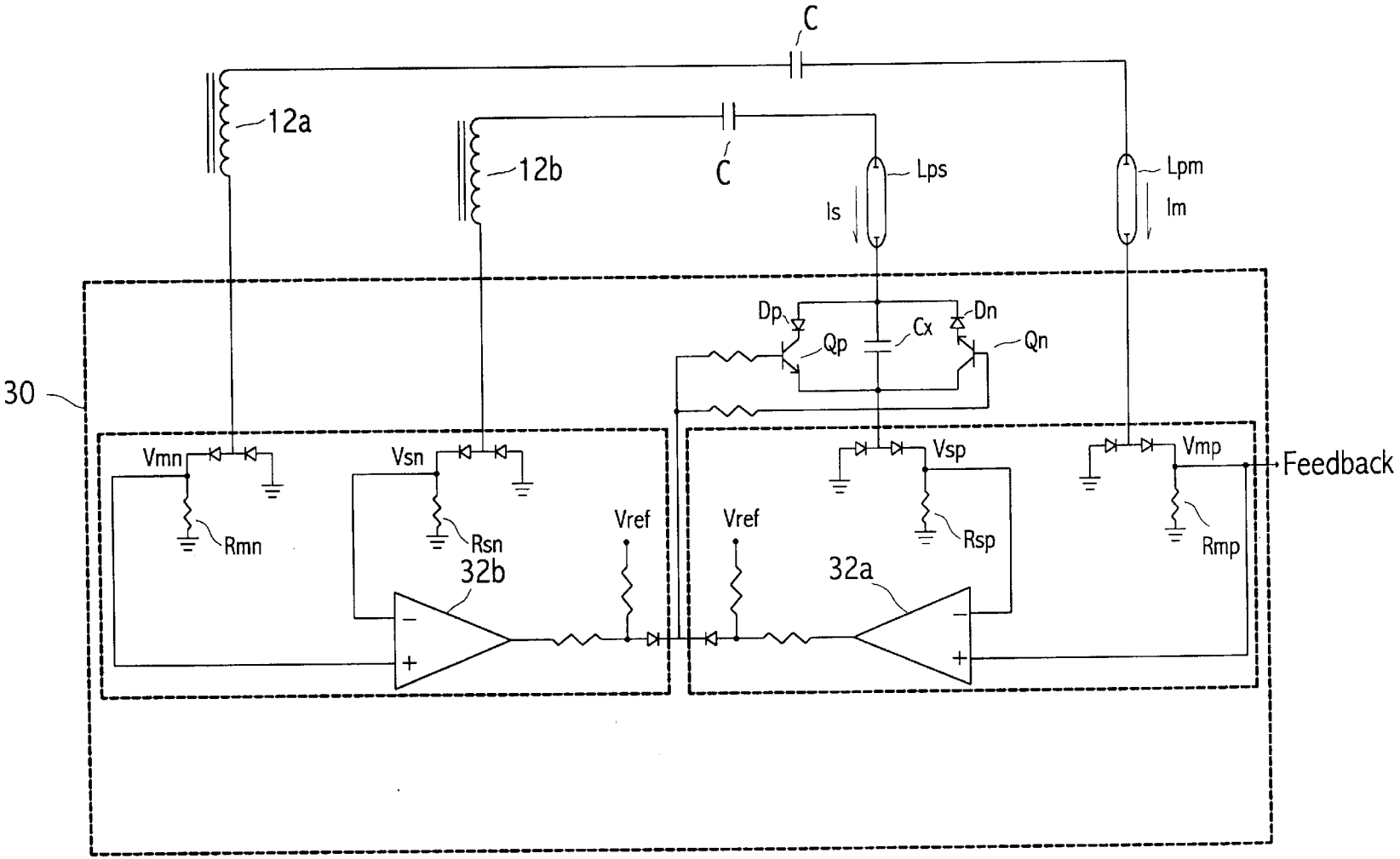
Fig. 5 〈 b 〉

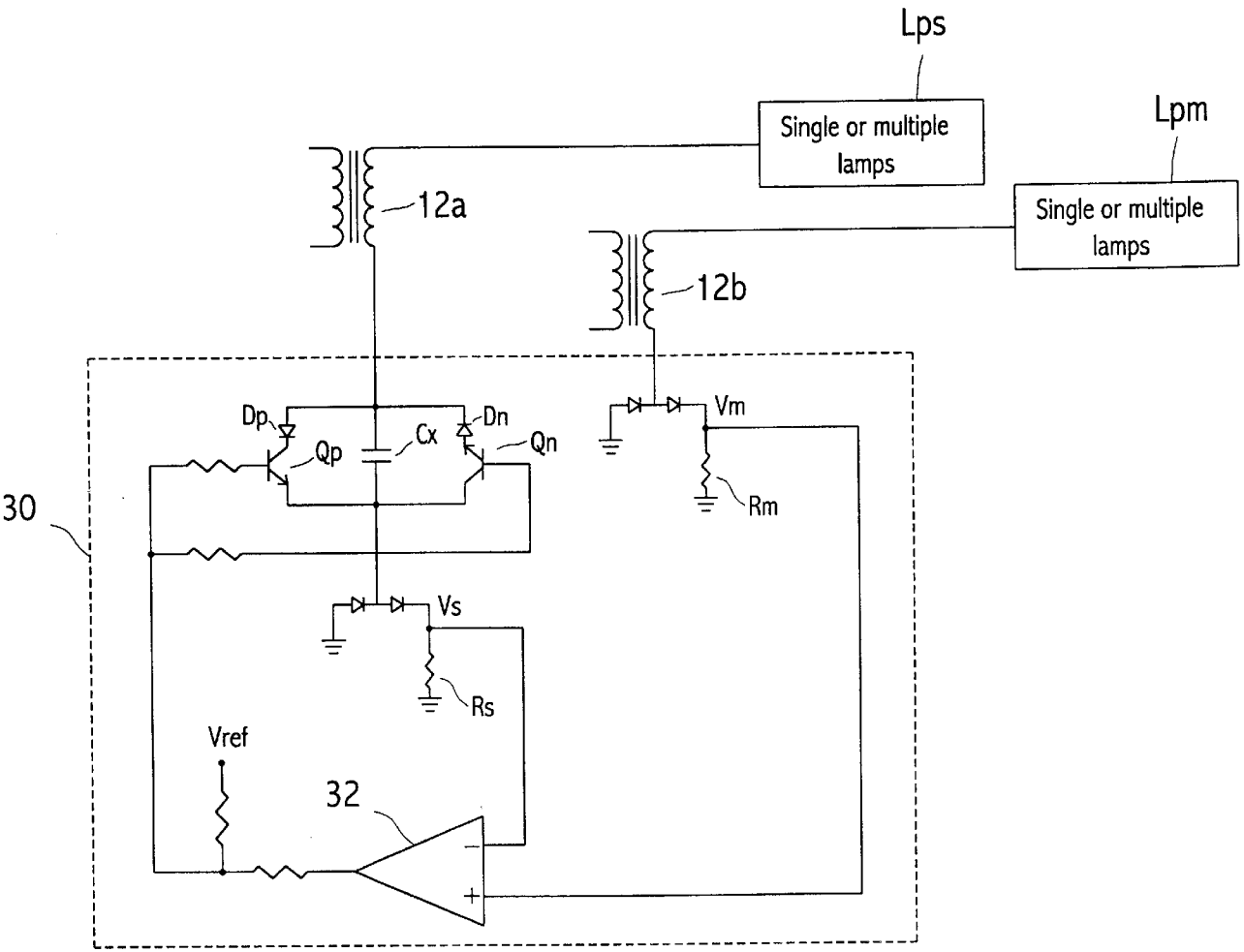
Fig. 5 〈 c 〉

POWER SUPPLY SYSTEM FOR MULTIPLE LOADS AND DRIVING SYSTEM FOR MULTIPLE LAMPS

BACKGROUND OF THE INVENTION

1. Field of the Invention

The present invention relates to a power supply system for multiple loads and, in particular, to a driving system for multiple discharge lamps in a backlight system of a LCD panel with a current balancing circuit for equalizing the current through each of the discharge lamps.

2. Description of the Related Art

Discharge lamps, such as cold cathode fluorescent lamps (CCFLs), are typically used in backlight systems of LCD panels. These discharge lamps are usually driven by inverter circuits. In a large LCD panel, multiple lamps are required to provide sufficient illumination. In such multi-lamp applications, driving two or more parallel-connected discharge lamps by only one transformer or one power conversion stage significantly influences the current passing through each of the lamps and causes uneven current distribution due to the impedances differences among lamps. The unbalanced current effect not only deteriorates the illumination uniformity of a LCD panel due to insufficient luminance of those lamps having too small currents, but also reduces the lifespan of the entire backlight system due to overheat of those lamps having too large currents. Moreover, in the case of using single power conversion stage and control loop to drive multiple lamps, the conditions such as the tolerances of components in an inverter and the variations of lamp properties with time are difficult to be completely considered and controlled in an original design.

Considering the above drawbacks, inmost existing inverters, one single power conversion stage and control loop are used to drive one discharge lamp. In order to drive multiple lamps, corresponding power conversion stages and control loops must be provided accordingly. FIG. 1 illustrates the structure of a conventional circuit using two power conversion stages and control loops to drive two lamps. Lamps Lpa and Lpb are respectively driven by transformers 16*a* and 16*b,* and the feedback signals are respectively obtained from sampling resistors Ra and Rb and fed to corresponding PWM (pulse width modulation) controllers (not shown). Although driving multiple lamps by providing multiple power conversion stages and control loops results in a balanced current in each of the multiple lamps, yet the amount of components is increased, which adds up to a higher cost and a larger mechanical volume. Furthermore, each of the power conversion stages operates at different frequencies. Such non-synchronous operation tends to result in a mutual interference, and more seriously, it may interfere the video signals of the LCD panel and result in ripple noises on the screen. Being viewed as a whole, such conventional circuit structure has the disadvantages of high cost, large mechanical volume and signal interferences, etc.

Another structure of conventional circuit for driving plural discharge lamps is illustrated in FIG. 2. A pair of series connected transformers 16*a* and 16*b* is used to drive two lamps Lpa and Lpb, and a common feedback loop is provided. The circuit in FIG. 2 improves the interference problem resulted from non-synchronous operation; however, the difference between the lamp currents is greater (than that in the circuit of FIG. 1). Therefore, this topology also fails to reach a good effect of current balancing.

SUMMARY OF THE INVENTION

It is therefore an object of the present invention to provide a power supply system for multiple loads, which effectively equalizes the current passing through each of the loads.

It is another object of the present invention to provide a driving system for multiple lamps particularly applied to the cold-cathode fluorescent lamps in the backlight system of a LCD panel, which effectively equalizes the current passing through each of the lamps to thereby improve the illumination uniformity of the LCD panel and increase the lifespan of the lamps, while reducing the production cost and the mechanical volume, and improving the interference problem resulted from non-synchronous operation.

It is still another object of the present invention to provide a driving system for multiple lamps, which simplifies the power conversion stages and control circuits in a multi-lamp driving system, and maintains the overall efficiency approximately at its optimum point to prevent it from significant decline due to heavy or light load.

To achieve the above objects, according to the present invention, an aspect of the driving system for multiple lamps comprises a plurality of lamps including one master lamp and at lease one slave lamp, an inverter circuit for converting DC power to AC power to be supplied to the lamps, and at lease one current balancing circuit having a capacitor seriesly connected to each of the slave lamps, so that the equivalent capacitive reactance of the capacitor varies with the current values of the master lamp and each of the slave lamps to thereby balance the currents through the master and slave lamps.

The current balancing circuit further comprises a first transistor and a second transistor with their collectors and emitters respectively coupled to the two ends of the capacitor so that the capacitor can be discharged when the first and second transistors are driven, current sampling circuit for master and slave lamps for obtaining the currents in the master and slave lamps, and a comparator circuit having two inputs coupled to the current sampling circuit for master and slave lamps and one output coupled to the bases of the first and second transistors for comparing the current values of the master lamp and the slave lamp and selectively outputting a voltage signal to drive the first and second transistors.

According to the present invention, another aspect of the driving system for multiple lamps comprises a first lamp and a second lamp, an inverter circuit for converting DC power to AC power to be supplied to the first and second lamps, and a current balancing circuit for balancing the currents through the first and second lamps.

The current balancing circuit further comprises a first capacitor seriesly connected to the first lamp, a second capacitor seriesly connected to the second lamp, a first transistor and a second transistor with their collectors and emitters respectively coupled to the two ends of the first capacitor and their bases coupled to the second capacitor, and a third transistor and a forth transistor with their collectors and emitters respectively coupled to the two ends of the second capacitor and their bases coupled to the first capacitor.

BRIEF DESCRIPTION OF DRAWINGS

Other features and advantages of the present invention will become more apparent by reference to the following description of preferred Embodiments taken in conjunction with the accompanying drawings, wherein:

FIGS. 5(*a*) to 5(*c*) are Variations of the first Embodiment according to the present invention, in which FIGS. 5(*a*) and 5(*b*) respectively shows a single-transformer application and a dual-transformer application provided with waveform control circuit for negative half cycle, and FIG. 5(*c*) shows a circuit structure having a common low voltage line for multiple lamps;

DETAILED DESCRIPTION OF THE INVENTION

Figure 1:
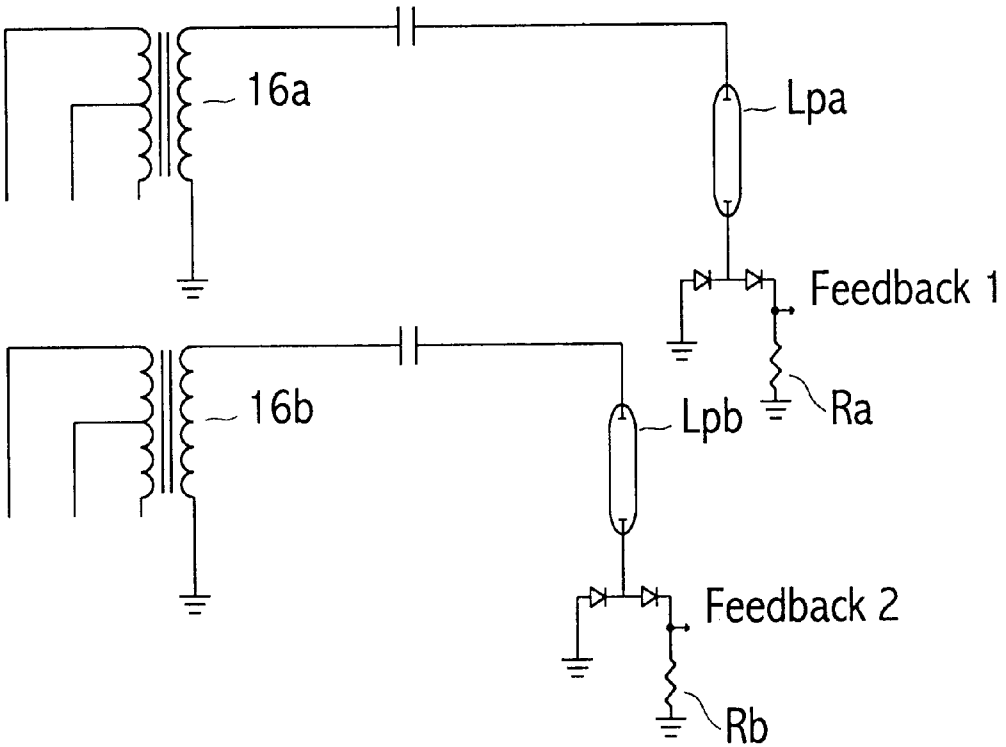
FIG. 1 illustrates the structure of a conventional circuit for driving a plurality of discharge lamps.
Figure 2:
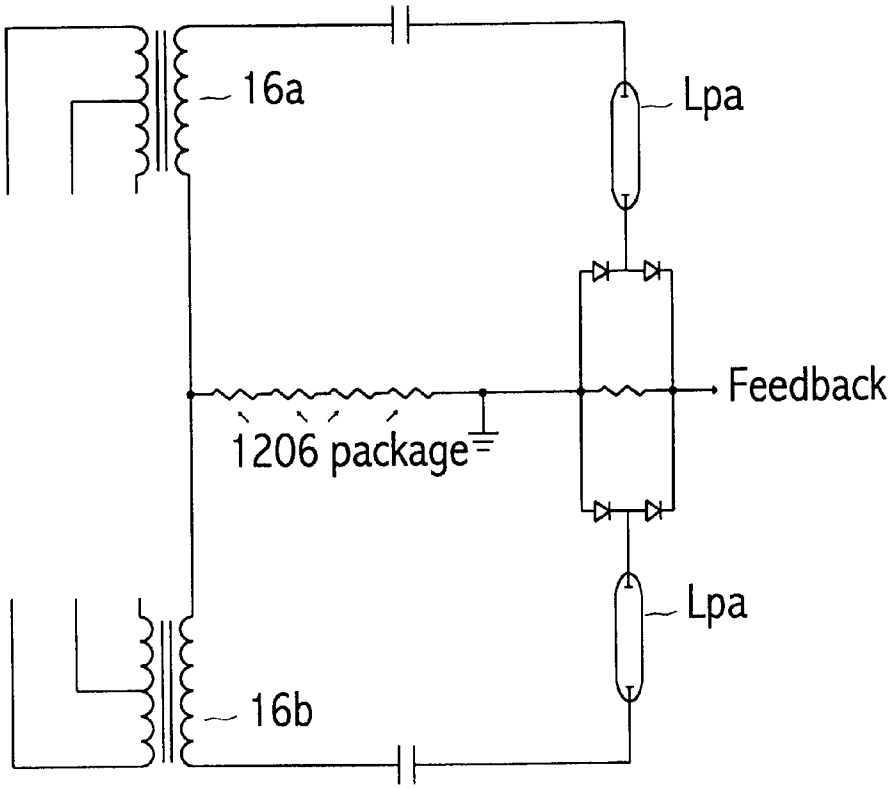
FIG. 2 illustrates the structure of another conventional circuit for driving a plurality of discharge lamps.
Figure 3:
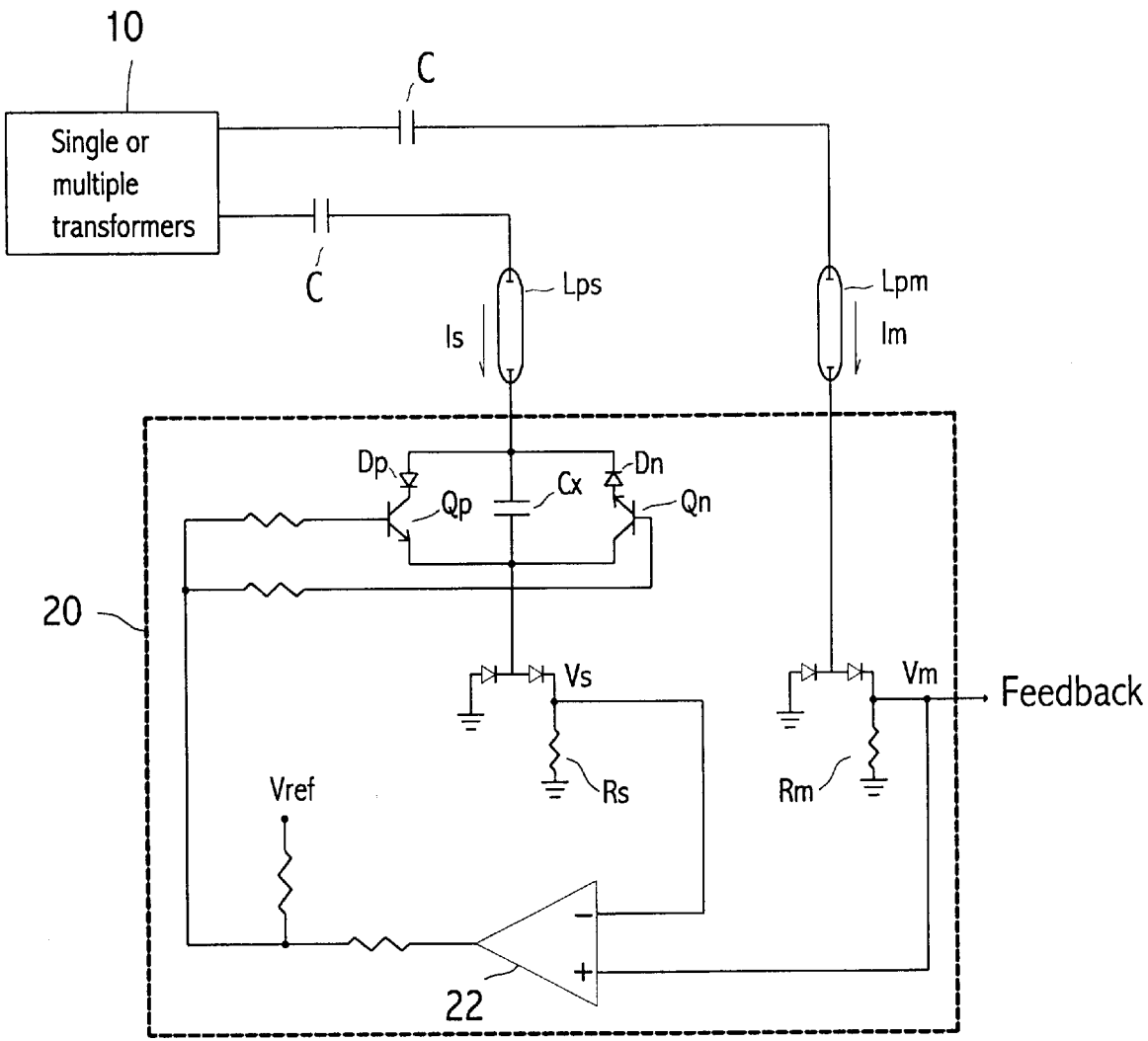
FIG. 3 illustrates the circuit of the first Embodiment according to the present invention.

FIG. 3 shows the circuit of the first Embodiment according to the present invention. As shown, the driving system for multiple lamps according to the present invention comprises a master lamp Lpm and a slave lamp Lps, a transformer 10 for supplying AC power to the master lamp Lpm and the slave lamp Lps respectively through decoupling capacitors C and C, and a current balancing circuit 20 for balancing the currents passing through the master lamp Lpm and the slave lamp Lps. As will be described later, the current balancing circuit acts like a variable capacitor so that the equivalent capacitive reactance thereof varies with the current values of the master lamp Lpm and slave lamp Lps to thereby linearly control the current waveform of the lamps to reach a balanced current distribution.

It should be noted that, although only one slave lamp and only current balancing circuit are shown in the circuit of FIG. 3, yet one skilled in this art may properly increase the number of slave lamps and current balancing circuits depending on the practical application in the way shown in FIG. 3. Also, single transformer or multiple transformers may be used in the transformer 10 depending on the number of lamps to be driven, the normal rated power of the transformer used and other considerations on design and cost. The above-mentioned variations will not reduce the current-balancing effect of the present invention.

The current balancing circuit 20 which is provided at the low-voltage end of the lamps comprises a capacitor Cx seriesly connected to the slave lamp Lps, a first transistor Qp and a second transistor Qn with their collectors and emitters respectively coupled to the two ends of the capacitor Cx, a first diode Dp and a second diode Dn respectively coupled to the collector/emitter of the first transistor Qp and the second transistor Qn, sampling resistors Rm and Rs seriesly connected to the master lamp Lpm and the slave lamp Lps respectively, and a comparator 22 having two inputs respectively connected to the sampling resistors Rm and Rs and one output connected to the bases of the first transistor Qp and the second transistor Qn.

The first and second transistors Qp and Qn in FIG. 3 are shown to be NPN transistors. However, PNP transistors may also be used as the first and second transistors Qp and Qn, yet the two input signals of the comparator 22 must be inversely connected. Furthermore, although BJT transistors are used in the balancing circuit of FIG. 3 and other Variations and Embodiments described later, yet it should be understood by one skilled in this art that these BJTs may also be replaced by other types of transistors, such as MOS transistors.

The operations of the first Embodiment in FIG. 3 will be described bellow. By using sampling resistors Rm and Rs, positive current waveforms of the master lamp Lpm and the slave lamp Lps can be obtained, that is, the current values Im and Is of the master lamp Lpm and the slave lamp Lps are converted into voltage values Vm and Vs in proportion thereto. These two voltage signals Vm and Vs are respectively fed to inverting and non-inverting inputs of the comparator 22, and the two possible results after the comparison by the comparator 22 are described as follows. In the first case, voltage Vm is greater than voltage Vs, i.e., the current Im passing through the master lamp Lpm is greater than the current Is passing through the slave lamp Lps. Therefore, the output voltage level of the comparator 22 raises and thereby drives the first transistor Qp and the second transistor Qn, which in turn discharges the capacitor Cx so that the equivalent capacitive reactance of the capacitor Cx decreases (It may also be deemed as a voltage modulation of a equivalent voltage source.), i.e., the equivalent capacitive reactance of the slave lamp Lps loop decreases, and thereby, the current Is passing therethrough increases. In the second case, voltage Vs is greater than voltage Vm, i.e., the current passing through the slave lamp Lps is greater than the current Im passing through the master lamp Lpm. Therefore, the output voltage level of the comparator 22 drops and fails to drive the first transistor Qp and the second transistor Qn to discharge the capacitor Cx, so that the capacitive reactance of the capacitor Cx stays at the original value ($Xc=1/\omega C$). Due to the increase of the equivalent capacitive reactance of the slave lamp Lps loop, the current Is passing therethrough decreases.

Figure 4B:
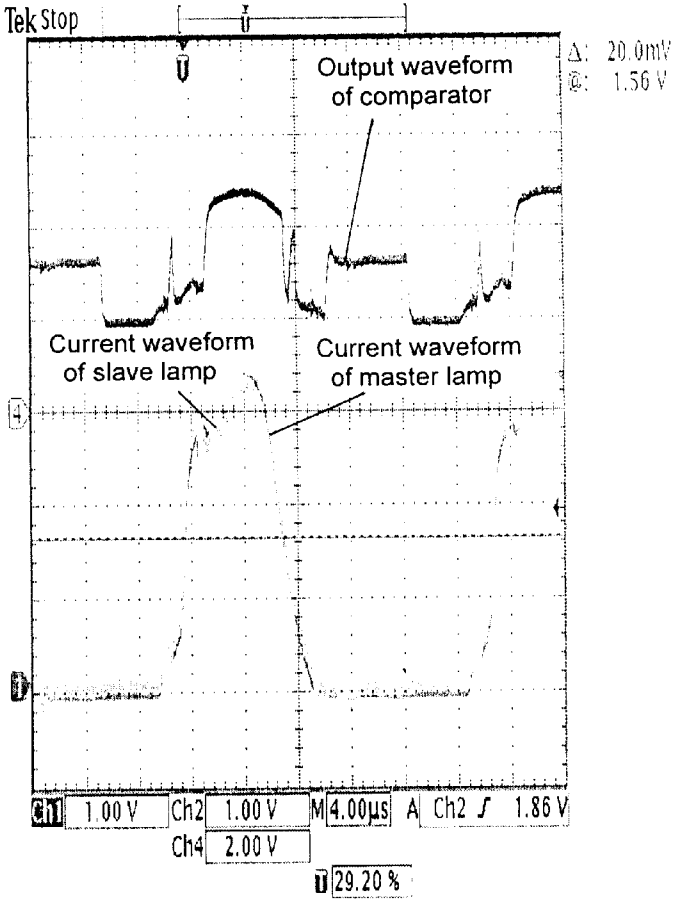
FIG. 4(*a*) shows the current waveforms of the lamps in a convention topology without a current balancing circuit, and FIG. 4(*b*) shows the current waveforms of the lamps in the present topology with a balancing circuit.
Figure 4A:
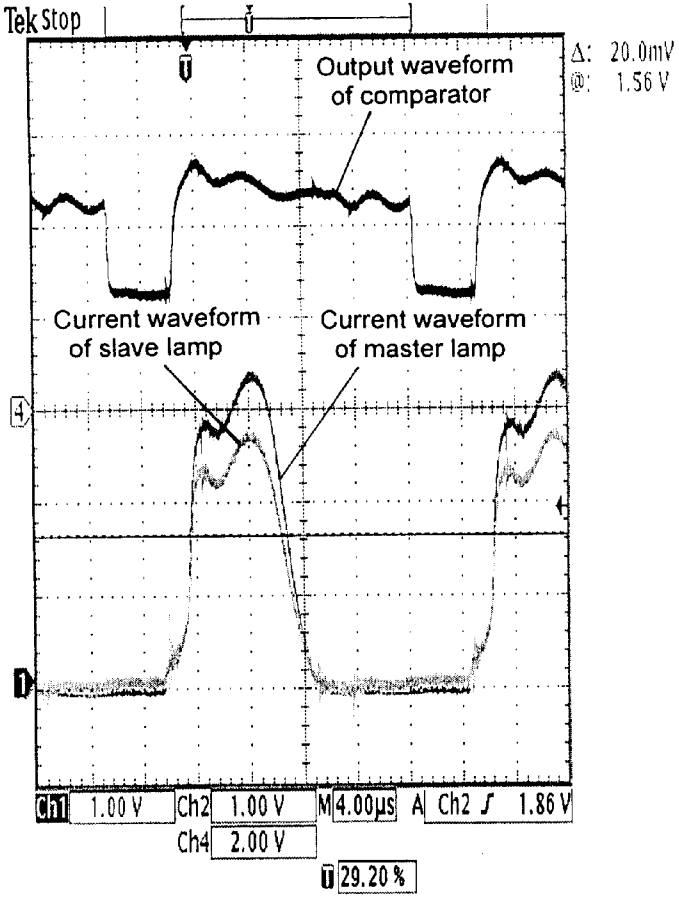

The current waveform of the master and slave lamps and the output waveform of the comparator are shown in FIG. 4, in which FIG. 4(*a*) shows the result of a conventional topology without a current balancing circuit and FIG. 4(*b*) shows the result of the present topology with a current balancing circuit. It should be noticed that, in the case of FIG. 4(*a*), transistors Qp and Qn are not provided in the circuit, but a comparator is provided for comparison with FIG. 4(*b*). In FIG. 4(*a*), the effective current value of the master lamp Lpm is 6.58 mA, and the effective current value of the slave lamp Lps is 5.36 mA. In FIG. 4(*b*), the effective current value of the master lamp Lpm is 6.56 mA, and the effective current value of the slave lamp Lps is 6.56 mA. In FIG. 4(*b*), it is clearly observed that the comparator 22 acts to drive the transistors Qp and Qn, so that the current waveform of the slave lamp Lps follows the current waveform of the master lamp Lpm to thereby reach a balanced current distribution.

In the above-mentioned first Embodiment of the present invention, although only positive current waveform of the lamp is controlled, yet the purpose of current balance is achieved and the waveform balance ratio of positive and negative half cycles is not affected.

To add a control circuit for negative current waveform, only an sampling circuit and comparator for negative current waveform is required, and additional capacitor Cx, transistors Qp, Qn and diodes Dp, Dn are unnecessary. FIG. 5(*a*) and FIG. 5(*b*) are variations of the first Embodiment according to the present invention, illustrating the circuit structures having a control circuit for negative current waveform respectively in the single-transformer and the dual-transformer applications.

FIG. 5(*a*) illustrates a circuit for driving two lamps by single transformer 12. A master lamp Lpm and a slave lamp Lps are coupled to the secondary side of a transformer 12 through decoupling capacitors C and C respectively. Sampling resistors Rmp, Rsp for positive current waveform and sampling resistors Rmn, Rsn for negative current waveform are respectively provided in the master lamp loop and the slave lamp loop. By using these sampling resistors, positive and negative current waveforms of the master lamp Lpm and the slave lamp Lps can be respectively obtained and converted into voltage signals Vmp, Vsp and Vmn, Vsn. Subsequently, voltage signals Vmp and Vsp are respectively fed into non-inverting and inverting inputs of the comparator 32*a,* and voltage signals Vmn and Vsn are respectively fed into inverting and non-inverting inputs of comparator 32*b*. The output signals of the comparators 32*a* and 32*b* are both coupled to bases of transistors Qp and Qn. Thereby, the comparator circuit 30 varies the equivalent capacitive reactance of capacitor Cx in response to the differences of the positive or negative current waveforms between the master lamp Lpm and the slave lamp Lps, and linearly controls the waveforms of the master lamp Lpm and the slave lamp Lps to reach a balanced current distribution.

FIG. 5(*b*) illustrates a circuit for driving two lamps by two transformers 12*a* and 12*b*. The circuit is also provided with sampling resistors Rmn, Rsn and current comparator 32*b* for negative current waveform. Although the structure is somewhat different from the circuit having single transformer as shown in FIG. 5(*a*), yet the operation principle is generally similar to the circuit in FIG. 5(*a*), which can be easily understood by the persons skilled in this art and thus the description is herein omitted.

FIG. 5(*c*) shows another Variation of the first Embodiment according to the present invention. In general applications, one lamp is provided with two lines, in which one is a high voltage line and the other a low voltage line. However, some products are designed with the low voltage lines of a plurality of lamps connected together to form a single low voltage line. For such structure with common low voltage line, modifications on circuit of the first Embodiment can be made to form the arrangement shown in FIG. 5(*c*).

Figure 6:
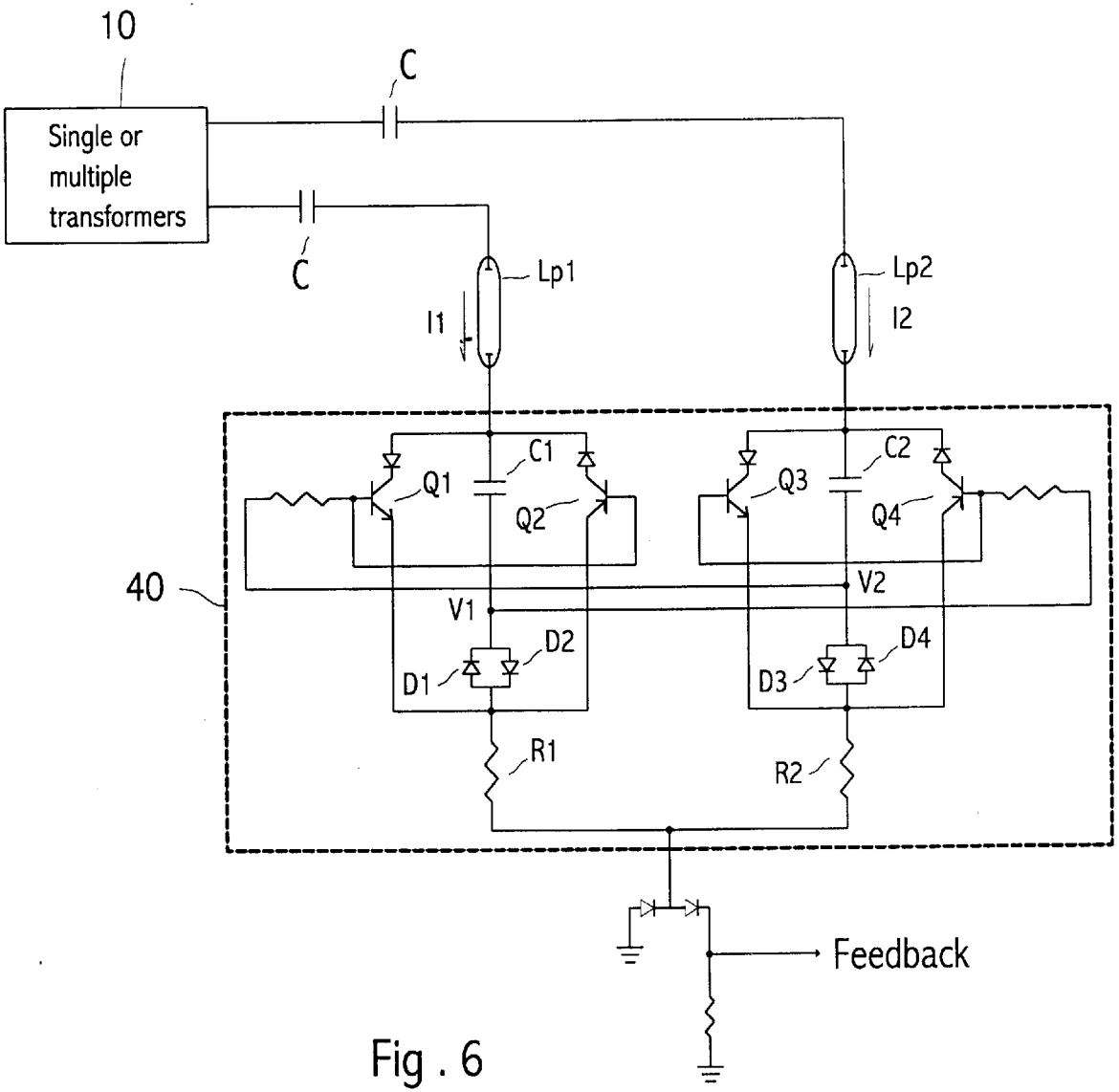
FIG. 6 illustrates the circuit of the second Embodiment according to the present invention.

FIG. 6 shows the circuit of the second Embodiment according to the present invention. In this Embodiment, the structure of the current balancing circuit is different from the one shown in the first Embodiment. As shown, the driving system for multiple lamps comprises a first lamp Lp1 and a second lamp Lp2, a transformer 14 for supplying AC power to the first lamp Lp1 and the second lamp Lp2 respectively through decoupling capacitors C and C, and a current balancing circuit 40 for equalizing the currents passing through the first lamp Lp1 and the second lamp Lp2.

The current balancing circuit 40 comprises a first capacitor C1, a pair of diodes D1 and D2 parallelly connected in opposite directions, and a first resistor R1 sequentially coupled to the first lamp Lp1 in series, a second capacitor C2, a pair of diodes D3 and D4 parallelly connected in opposite directions, and a second resistor R2 sequentially coupled to the second lamp Lp2 in series, a first transistor Q1 and a second transistor Q2 with their collectors and emitters respectively coupled to the two ends of the first capacitor C1 and their bases coupled to the node between the second capacitor C2 and the diodes D3, D4, and a third transistor Q3 and a forth transistor Q4 with their collectors and emitters respectively coupled to the two ends of the second capacitor C2 and their bases coupled to the node between the first capacitor C1 and the diodes D1, D2. The first and third transistors Q1 and Q3 are NPN transistors, and the second and forth transistors Q2 and Q4 are PNP transistors.

Next, the operation of the second Embodiment in FIG. 6 will be described as follows. If the voltage V1 is greater than the voltage V2, i.e., the current I1 passing through the first lamp Lp1 is greater than the current I2 passing through the second lamp Lp2, the first transistor Q1 and the second transistor Q2 will enter into cut-off region (Ic=0) and the third transistor Q3 and the forth transistor Q4 will operate. During positive half cycle, third transistor Q3 enters into active or saturation region, and the forth transistor Q4 stays in cut-off region; during negative half cycle, the forth transistor Q4 enters into active or saturation region, and the third transistor Q3 stays in cut-off region. The operation of transistors Q1 and Q2 entering into cut-off region causes the equivalent capacitive reactance of the capacitor C1 in the first lamp loop increases, and the operation of transistors Q3 and Q4 entering into active or saturation region causes the equivalent capacitive reactance of the capacitor C2 in the second lamp loop decreases. Therefore, the current I1 decreases and the current I2 increases. On the contrary, if the current I2 of the second lamp Lp2 is greater than the current I1 of the first lamp Lp1, the third transistor Q3 and the forth transistor Q4 will enter into saturation region and the first transistor Q1 and the second transistor Q2 will enters into the active or saturation region. These operations cause the equivalent capacitive reactance of the capacitor C2 in the second lamp loop increases and the equivalent capacitive reactance of the capacitor C1 in the first lamp loop decreases. Therefore, the current I2 decreases and the current I1 increases. Thereby, a balanced current distribution is achieved.

In the circuit of the second Embodiment according to the present invention, the diodes D1~D4 are provided for compensating the voltage $V_{BE}$ (about 0.6V) between the base and emitter of the transistors Q1~Q4 in the active region.

Further, it should be noticed that, according to the present invention, the capacitors Cx, C1 and C2 in the balancing circuits of the each Embodiment and Variation may be replaced by other impedance devices, such as resistors or inductors, depending on the requirements of practical circuit design, which does not affect current balancing effect.

The current balancing circuit of the present invention is a real time current waveform feedback control circuit, which, in multi-lamp applications, ensures that the current waveform of each slave lamp precisely follows the current waveform of the master lamp and reaches an almost the same effective current value. Such an arrangement effectively eliminates the possible negative effects due to lamp properties variations, balances the currents through different lamps, extends the lifespan of lamps, and equalizes the illumination of each lamp. Moreover, the driving system for multiple lamps according to the present invention may drive multiple lamps by only one single power conversion stage and control loop, and therefore fewer components are used, which not only lowers production cost, but also reduces the mechanical volume of the inverter to be more suitable for use in the increasingly compact electronic products. Particularly, when more lamps are used in the circuit of the present invention, there will be notable effectiveness of lowing cost and reducing volume. Moreover, since the operation frequency is synchronized, the non-synchronous interference problem is eliminated.

Since the switch circuit and control circuit of the present invention are provided at the low voltage end, high voltage components or techniques are not required, which reinforces the reliability of the circuit and lowers the production cost.

Figure 7:
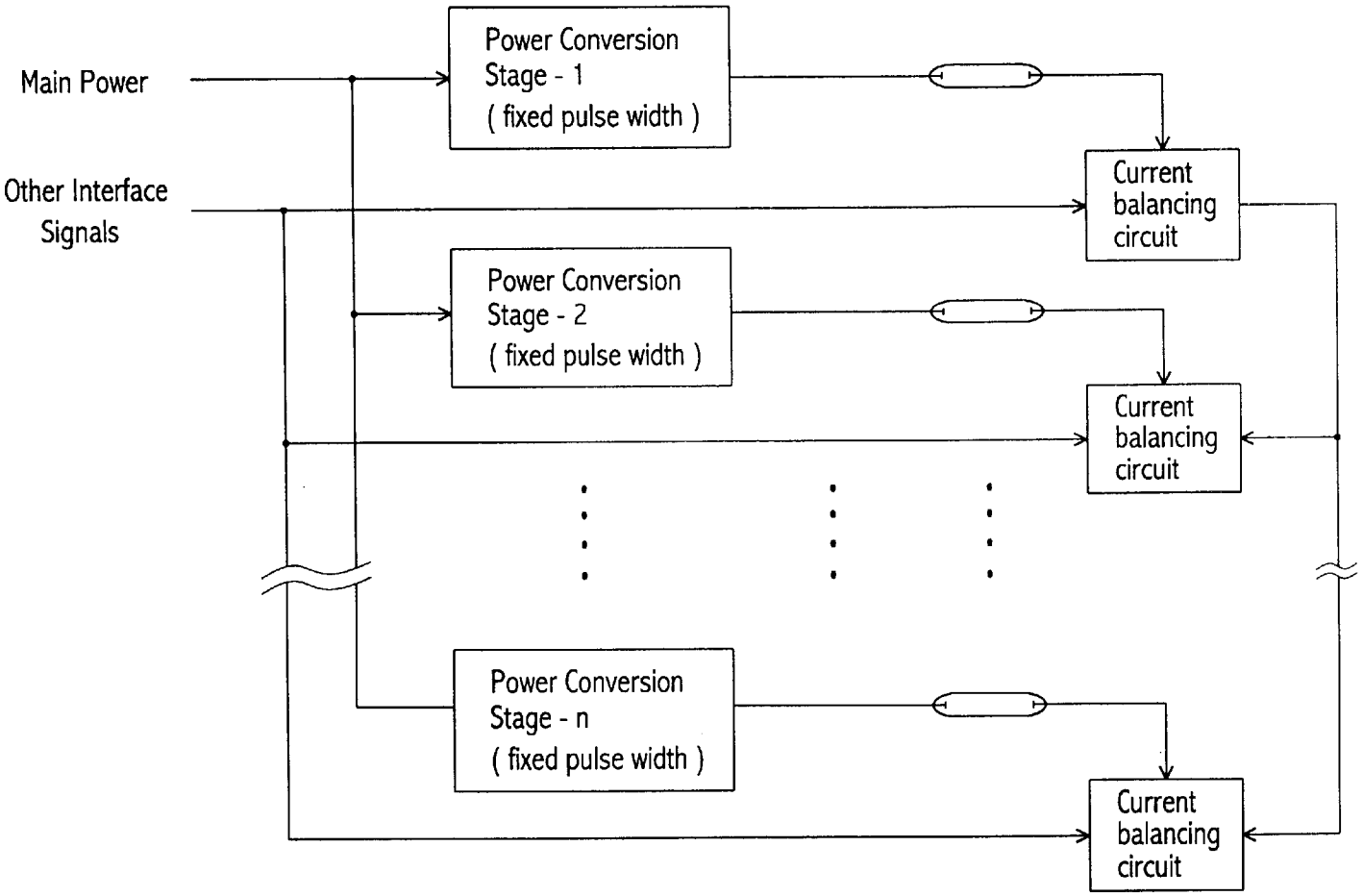
FIG. 7 illustrates the circuit structure of the present invention with multiple power conversion stages for driving multiple lamps.

Further, according to the present invention, by using the current balancing feature of the circuit, it is possible to simplify the circuit structure of other power conversion stage except for the master power conversion stage and even remove the control circuits. Specifically, as shown in FIG. 7, when the number of the lamps grows and the normal rated power of a single transformer is insufficient to drive all the lamps, multiple transformers may be used. Excluding the master transformer, the remaining slave transformers are driven with fixed pulse width. With the corporation of balancing circuits, the current is controlled and. The fixed pulse width can be selected to the full load pulse width so as to maintain the driving circuit approximately at the optimum working point. Hence, the overall efficiency is improved and no significant reduction in the efficiency is caused under light or heavy load.

Although the present invention has been described above with reference to driving circuits for lamps, especially for the discharge lamps in the backlight system of a LCD panel, yet persons skilled in this art may understand that the current balancing circuit of the present invention is also applicable to the multi-load driving systems for different types of loads and reaches a balanced current in each load. The above-mentioned descriptions are merely illustrative and not restrictive. Any variation or modification made according to the appended claims shall fall into the scope of the present invention.

What is claimed is:

1. A driving system for multiple lamps including a first lamp and a second lamp, comprising:

an inverter circuit for converting DC power to AC power to be supplied to said first and second lamps; and a current balancing circuit for balancing the currents passing through said first and second lamps;

wherein said current balancing circuit comprising:

a first impedance device coupled to said first lamp;

a second impedance device coupled to said second lamp;

a first transistor with its collector and emitter respectively coupled to the two ends of said first impedance device and with its base coupled to said second impedance device; and a third transistor with its collector and emitter respectively coupled to the two ends of said second impedance device and with its base coupled to said first impedance device.

2. A power supply system for driving multiple loads including a first load and a second load, comprising:

an inverter circuit for converting DC power to AC power to be supplied to said loads; and a current balancing circuit, comprising:

a variable impedance circuit coupled to said second load;

a current sampling circuit for obtaining the current values through said first load and through said second load; and a comparator circuit with its input terminals coupled to said current sampling circuit and its output terminal coupled to said variable impedance circuit for comparing the current values through said first load and through said second load and selectively outputting a control signal to vary the equivalent impedance of said variable impedance circuit to thereby balance the current values through said first load and through said second load.

3. A power supply system for multiple loads including a master load and a slave load, comprising:

a driving circuit for supplying power to said loads; and a current balancing circuit for balancing the currents passing through said master load and said slave load;

wherein said current balancing circuit comprising:

a variable impedance circuit including an impedance device coupled to said slave load, a first transistor and a second transistor with their collectors and emitters respectively coupled to the two ends of said impedance device so that the equivalent impedance of said variable impedance circuit varies when either of said first and second transistors is driven;

current sampling circuit for obtaining the current values of said master load and said slave load; and comparator circuit with its input coupled to said current sampling circuit and its output coupled to the bases of said first and said second transistors for comparing the currents passing through said master and slave loads and selectively outputting a control signal to drive said first and second transistors.

4. The power supply system for multiple loads according to claim 3, wherein said impedance device is a capacitor.

5. The power supply system for multiple loads according to claim 3, wherein said impedance device is a resistor.

6. The power supply system for multiple loads according to claim 3, wherein said impedance device is an inductor.

7. A driving system for multiple lamps including a first lamp and a second lamp, comprising:

an inverter circuit for converting DC power to AC power to be supplied to said first and second lamps; and a current balancing circuit for balancing the currents passing through said first and second lamps;

wherein said current balancing circuit comprising:

a first impedance device coupled to said first lamp;

a second impedance device coupled to said second lamp;

a first transistor and a second transistor with their collectors and emitters respectively coupled to the two ends of said first impedance device and with their bases coupled to said second impedance device; and a third transistor and a forth transistor with their collectors and emitters respectively coupled to the two ends of said second impedance device and with their bases coupled to said first impedance device.

8. The driving system for multiple lamps according to claim 7, wherein said impedance device is a capacitor.

9. The driving system for multiple lamps according to claim 7, wherein said impedance device is a resistor.

10. The driving system for multiple lamps according to claim 7, wherein said impedance device is an inductor.

11. The driving system for multiple lamps according to claim 7, wherein said first and third transistors are NPN transistors, and said second and forth transistors are PNP transistors.

12. The driving system for multiple lamps according to claim 7, further comprising a first pair of diodes for compensating the voltage between the bases and emitters of said first and second transistors and a second pair of diodes for compensating the voltage between the bases and emitters of said third and forth transistors.

13. The driving system for multiple lamps according to claim 7, wherein said inverter circuit includes a single transformer.

14. The driving system for multiple lamps according to claim 7, wherein said inverter circuit includes a plurality of transformers.

15. A driving system for multiple lamps including a master lamp and a slave lamp, comprising:

an inverter circuit for converting DC power to AC power to be supplied to said lamps; and a current balancing circuit including a variable impedance circuit coupled to said slave lamp, and a circuit for sampling the current values through said master lamp and through said slave lamp and for accordingly outputting a control signal to vary the equivalent impedance of said variable impedance circuit to thereby balance the current in said master and slave lamps.

16. The driving system for multiple lamps according to claim 15, wherein said circuit for sampling the current values and for outputting the control signal comprises a sampling circuit for obtaining the positive current waveforms of said master and slave lamps and a comparator for comparing the positive current waveforms of the master and slave lamps.

17. The driving system for multiple lamps according to claim 15, wherein said circuit for sampling the current values and for outputting the control signal comprises a sampling circuit for obtaining the positive and negative current waveform of said master and slave lamps and two comparators respectively for comparing the positive current waveforms and the negative current waveforms of said master and slave lamps.

18. The driving system for multiple lamps according to claim 15, wherein said inverter circuit includes a single transformer.

19. The driving system for multiple lamps according to claim 1, wherein said inverter circuit includes a plurality of transformers.

20. The driving system for multiple lamps according to claim 15, wherein said variable impedance circuit comprises:

an impedance device connected in series with said slave lamp; and a first transistor and a second transistor with their collectors and emitters respectively coupled to the two ends of said impedance device, so that the equivalent impedance of said variable impedance circuit varies when either of said first and second transistors is driven.

21. The driving system for multiple lamps according to claim 20, wherein said impedance device is a capacitor.

22. The driving system for multiple lamps according to claim 20, wherein said impedance device is a resistor.

23. The driving system for multiple lamps according to claim 20, wherein said impedance device is an inductor.

24. A driving system for multiple lamps including a master lamp and a slave lamp, comprising:

an inverter circuit for converting DC power to AC power to be supplied to said lamps; and a current balancing circuit, comprising:

a variable impedance circuit coupled to said slave lamp;

a current sampling circuit for obtaining the current values through said master lamp and through said slave lamp; and a comparator circuit with its input terminals coupled to said current sampling circuit and its output terminal coupled to said variable impedance circuit for comparing the current values through said master lamp and through said slave lamp and selectively outputting a [voltage] control signal to vary the equivalent impedance of said variable impedance circuit to thereby balance the current values through said master lamp and through said slave lamp.

25. The system according to claim 24, wherein said variable impedance circuit comprises:

a capacitor connected in series with said slave lamp; and a transistor having a gate coupled to said output terminal of said comparator circuit, a collector and an emitter respectively coupled to the two ends of said capacitor, so that the equivalent impedance of said variable impedance circuit varies when said transistor is driven.

26. The system according to claim 24, wherein said variable impedance circuit comprises:

a resistor connected in series with said slave lamp; and a transistor having a gate coupled to said output terminal of said comparator circuit, a collector and an emitter respectively coupled to the two ends of said resistor, so that the equivalent impedance of said variable impedance circuit varies when said transistor is driven.

27. The system according to claim 24, wherein said variable impedance circuit comprises:

an inductor connected in series with said slave lamp; and a transistor having a gate coupled to said output terminal of said comparator circuit, a collector and an emitter respectively coupled to the two ends of said inductor, so that the equivalent impedance of said variable impedance circuit varies when said transistor is driven.

28. The system according to claim 24, wherein said variable impedance circuit comprises:

a capacitor connected in series with said slave lamp; and a first transistor and a second transistor with their gates coupled to said output terminal of said comparator circuit, and with their collectors and emitters respectively coupled to the two ends of said capacitor, so that the equivalent impedance of said variable impedance circuit varies when either of said transistors is driven.

29. The system according to claim 24, wherein said variable impedance circuit comprises:

a resistor connected in series with said slave lamp; and a first transistor and a second transistor with their gates coupled to said output terminal of said comparator circuit, and with their collectors and emitters respectively coupled to the two ends of said resistor, so that the equivalent impedance of said variable impedance circuit varies when either of said transistors is driven.

30. The system according to claim 24, wherein said variable impedance circuit comprises:

an inductor connected in series with said slave lamp; and a first transistor and a second transistor with their gates coupled to said output terminal of said comparator circuit, and with their collectors and emitters respectively coupled to the two ends of said inductor, so that the equivalent impedance of said variable impedance circuit varies when either of said transistors is driven.

31. The system according to claim 24, wherein said current sampling circuit is used for obtaining the positive current waveforms of said master and slave lamps; and said comparator circuit includes one comparator for comparing the positive current waveforms of the master and slave lamps.

32. The system according to claim 24, wherein said current sampling circuit is used for obtaining the positive and negative current waveform of said master and slave lamps; and said comparator circuit includes two comparators respectively for comparing the positive current waveforms and the negative current waveforms of said master and slave lamps.

* * * * *